United States Patent [19]

Beamenderfer et al.

[11] Patent Number: 5,074,808

[45] Date of Patent: Dec. 24, 1991

[54] MOLDED STRAIN RELIEF IN BACK SHELL

[75] Inventors: Robert E. Beamenderfer, Palmyra; Wayne S. Griffiths, York; Keith S. Koegel, Linglestown, all of Pa.

[73] Assignee: AMP Incorporated, Harrisburg, Pa.

[21] Appl. No.: 651,670

[22] Filed: Feb. 6, 1991

[51] Int. Cl.[5] ..... H01R 13/648

[52] U.S. Cl. ..... 439/606; 439/736; 29/855

[58] Field of Search ..... 439/296, 456, 460, 606, 439/609, 736, 901, 499, 497; 29/855

[56] References Cited

U.S. PATENT DOCUMENTS 4,586,776 5/1986 Ollis et al. ..... 439/736 X
4,602,830 7/1986 Lockard ..... 439/736 X
4,781,615 11/1988 Davis et al. ..... 439/395
4,875,877 10/1989 Fleak et al. ..... 439/497
5,009,614 5/1990 Fogg et al. ..... 439/497

FOREIGN PATENT DOCUMENTS 1020395 12/1957 Fed. Rep. of Germany ..... 439/736

*Primary Examiner*—Eugene F. Desmond
*Attorney, Agent, or Firm*—Gerald K. Kita

[57] ABSTRACT

An electrical connector (1) comprising, an insulative housing block (16), conductive electrical contacts (9) in the housing block (16) connected to corresponding signal wires (2), a conductive ground bus (10) connected to corresponding ground wires (5), plastics material (28) at a rear of the housing block (16) imbedding the ground bus (10) and a portion of the cable (1), and a conductive shell (29) enclosing the plastics material (28).

10 Claims, 4 Drawing Sheets

A-A

MOLDED STRAIN RELIEF IN BACK SHELL

FIELD OF THE INVENTION

The invention relates to an electrical connector with a strain relief, and more particularly, to a connector having a back shell and a strain relief secured to electrical wires where they enter an electrical connector in the back shell. The invention further relates to a connector assembly for connection to conductive wires to form a cable assembly.

BACKGROUND OF THE INVENTION

A known electrical connector is disclosed in U.S. application Ser. No. 07/531,203, filed May 31, 1990, now U.S. Pat. No. 5,009,614, and comprises, an insulative housing block, conductive electrical contacts in the housing block connected to corresponding signal wires, a conductive ground bus connected to corresponding ground wires, plastics material at a rear of the housing block imbedding the ground bus and a portion of the cable, and a conductive shell enclosing the plastics material. The signal wires and ground wires comprise coaxial cables, as disclosed in U.S. Pat. No. 4,875,877.

SUMMARY OF THE INVENTION

The connector of the invention includes the wires bent along an arc, and the plastics material encapsulating the wires along the arc to provide a strain relief that prevents tension on the wires from pulling the wires straight out from the rear of the connector.

According to another feature of the invention, the plastics material is cast in place within a mold cavity of a size and shape conforming to the interior of a conductive back shell, for example, a back shell as disclosed in U.S. Pat. No. 4,781,615.

The plastics material supports the imbedded wires and is supported against the shell interior to resist tensile forces on the wires.

For an understanding of the invention, reference will now be made to a detailed description taken in conjunction with accompanying drawings.

DESCRIPTION OF THE DRAWINGS

According to the drawings.

With reference to FIGS. 2 and 3, an electrical cable 1 is constructed with an elongated signal wire 2 or center conductor concentrically encircled by a dielectric 3, in turn encircled by a flexible insulative outer jacket 4 or sheath. A corresponding, elongated and conductive ground wire 5 or drain wire extends along the exterior of the dielectric 3 and is within the jacket 4. The cable 1 may include a single ground wire 5, as shown, or may include first and second ground wires 5, not shown, to provide a combination of a signal wire 2 between two ground wires 5. The invention applies to either cable construction, or to any other cable construction, not shown, such as a coaxial cable. The cable construction is cut to expose and to project the signal wire 2, the dielectric 3 and the corresponding ground wire 5 from the jacket 4.

An electrical connector 6, FIG. 1, is to be connected to one or multiple cables 1. With reference to FIGS. 2 and 3, construction of the connector 6 begins with a series of elongated electrical contacts 9 in a row. The contacts 9 project forwardly from an elongated ground bus 10. A series of pilot holes 11 extend through the ground bus 10. The contacts 9 when joined to the ground bus 10 provide a lead frame 12, known as an array of conductive paths for conducting electricity, with the paths joined together and cut out from a strip of metal. Each of the contacts 9 includes a pair of spaced apart fingers 13 defining an electrical receptacle 14 at a front end. The fingers 13 are cut out from the strip of metal while the metal is in a flat plane. The fingers 13 of each of the contacts 9 are formed by bending, such that the fingers 13 are pivoted out of the plane of the metal to oppose each other and to define therebetween the receptacle 14. The contacts 9 are on pitch spacings, that are the repeated spacings between longitudinal axes of the multiple contacts 9 in a row.

With reference to FIGS. 2 and 3, a housing block 16 is applied to each contact 9. For example, the housing block 16 is formed by injection molding a fluent plastics material that embeds the contacts 9. A front end 17 of the housing block is formed with a front wall 18 extending transverse to the row of contacts 9. The housing block 16 extends to a rear wall 20 from which the ground bus 10 projects. Wire connecting portions 21 of the contacts 9 appear at corresponding spaced apart, openings 22 formed by molding the housing block 16. Wire connecting portions 23, FIGS. 9 and 10, of the ground bus 10 extend from the ground bus 10. Removable portions 19 of the ground bus 10 attach to a carrier strip 24 having the pilot holes 11. The housing block 16 holds all the contacts 9 on a desired pitch spacing.

Figure 1:
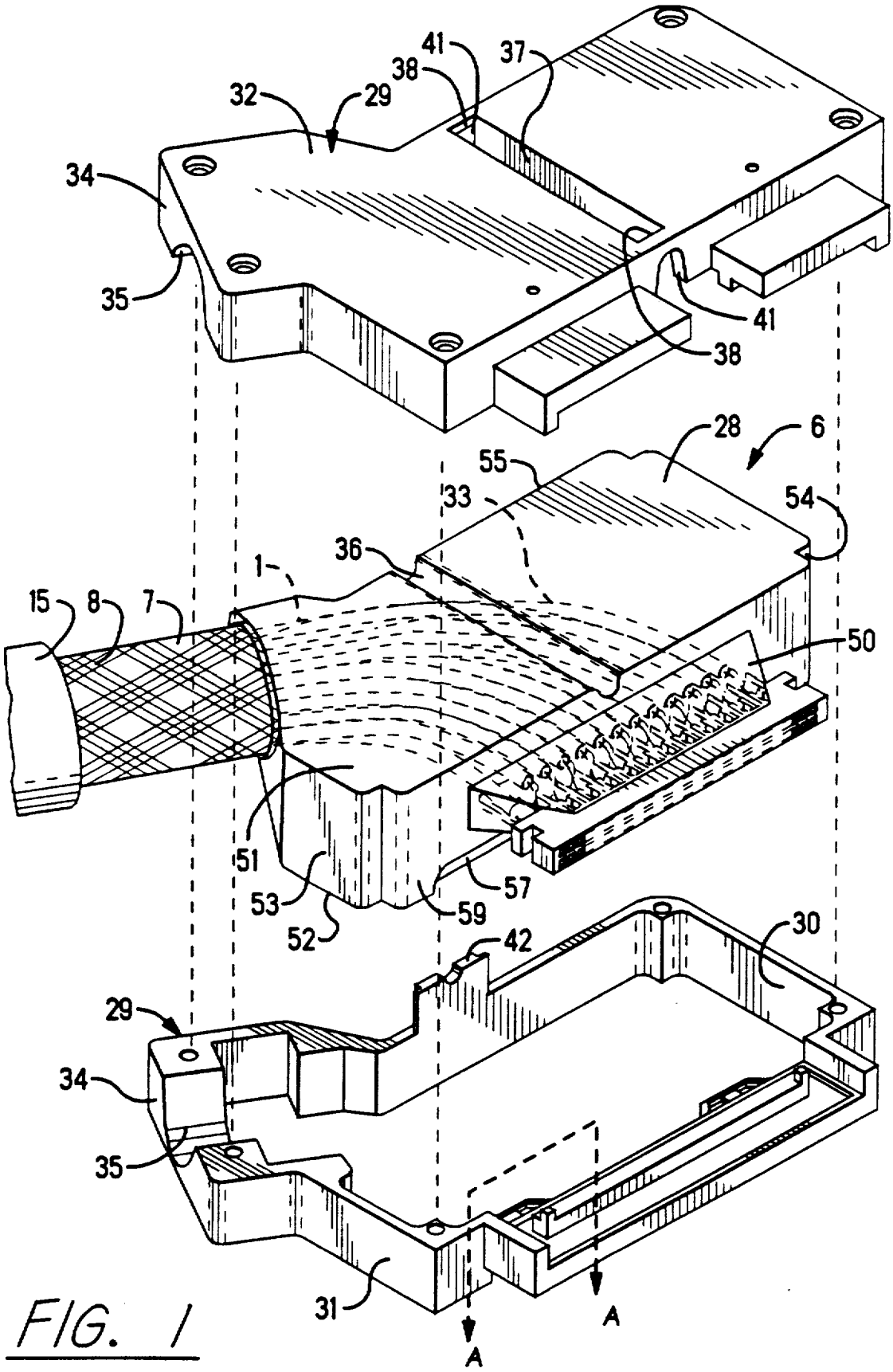
FIG. 1 is a perspective view of a connector with parts shown separated from one another.
Figure 2:
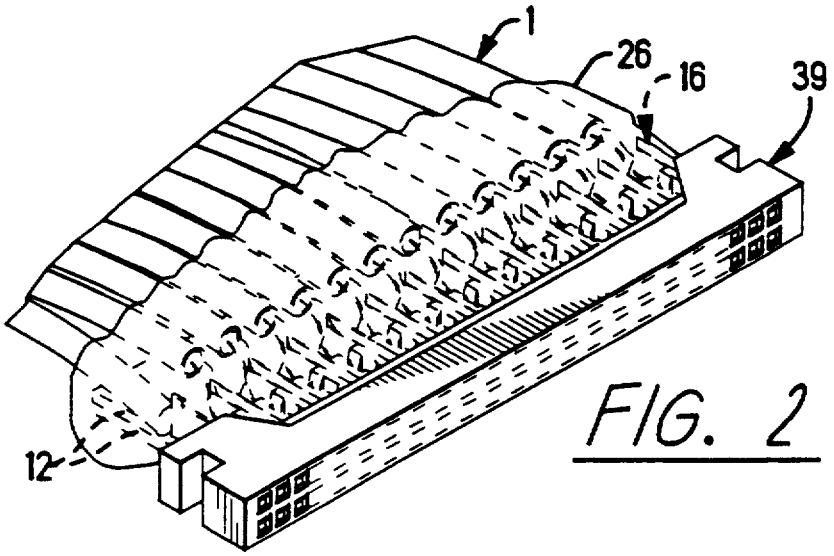
FIG. 2 is a fragmentary perspective view of a portion of the connector shown in FIG. 1.

Wire receiving channels 25, formed by molding the housing block 16, extend from the rear wall 20 and forwardly and axially of corresponding contacts 9 and corresponding wire connecting portions 23. An end 28 of the jacket 4 of a corresponding cable 1 opposes the rear wall 20. The signal wire 2 of the cable 1 and each corresponding ground wire 5 of the cable 1 extend along corresponding channels 25. The signal wire 2 extends along the channel 25 to the wire connecting portion 21 of a corresponding contact 9. Each corresponding ground wire 5 extends along a corresponding channel 25 to the wire connecting portion 23.

Further details of construction of the housing block 16 are described in U.S. Pat. No. 4,875,877, according to which, the connection between a corresponding wire 2 or 5 and a corresponding wire connecting portion 21 or 23 is accomplished by a welding operation or a soldering operation. Each contact 9 that is connected to a signal wire 2 is designated a signal contact. Each contact 9 that remains connected to the ground bus 10 is designated a ground contact. Each contact 9 that is removed from the ground bus 10 will designate that contact 9 as a signal contact.

Figure 3:
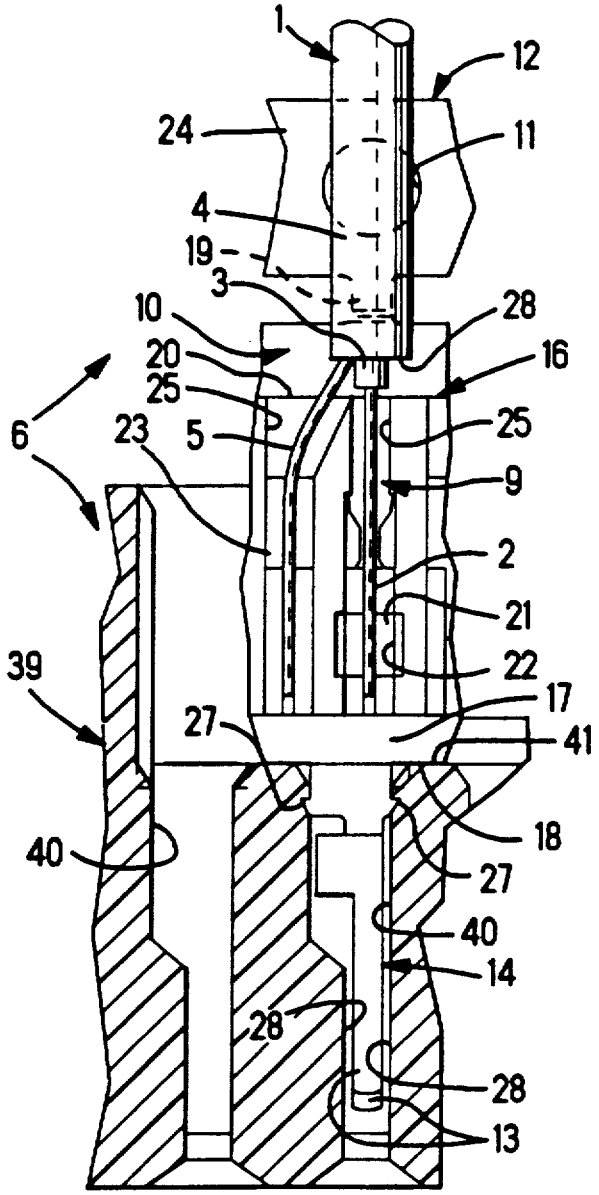
FIG. 3 is an enlarged section view of the portion of the connector shown in FIG. 2, further illustrating wires connected to contacts on a housing block.

The contacts 9 project forward of the housing block 16 for assembly with an insulative housing 39. The housing 39 includes multiple contact receiving cavities 40 in a row and spaced apart on pitch spacings corresponding to that of the series of contacts 9. A representative contact 9 is shown fully assembled in a corresponding, representative cavity 40 in a representative row, FIG. 3, with the front 18 of the housing block 10 engaging a rear 41 of the housing 39. Fins 27 engage opposite interior walls of the cavity to hold the contact 9 in stable position, and to lock the contact 9 and the housing 39. The fins 27 hold the contacts 9 in the cavities 40 against undesired movement. Clearances 28 between the interior walls of the cavity 40 and the contact 9 allow the fingers 13 to move apart in response to insertion of a conductive terminal post, not shown, into the receptacle 14.

Figure 4:
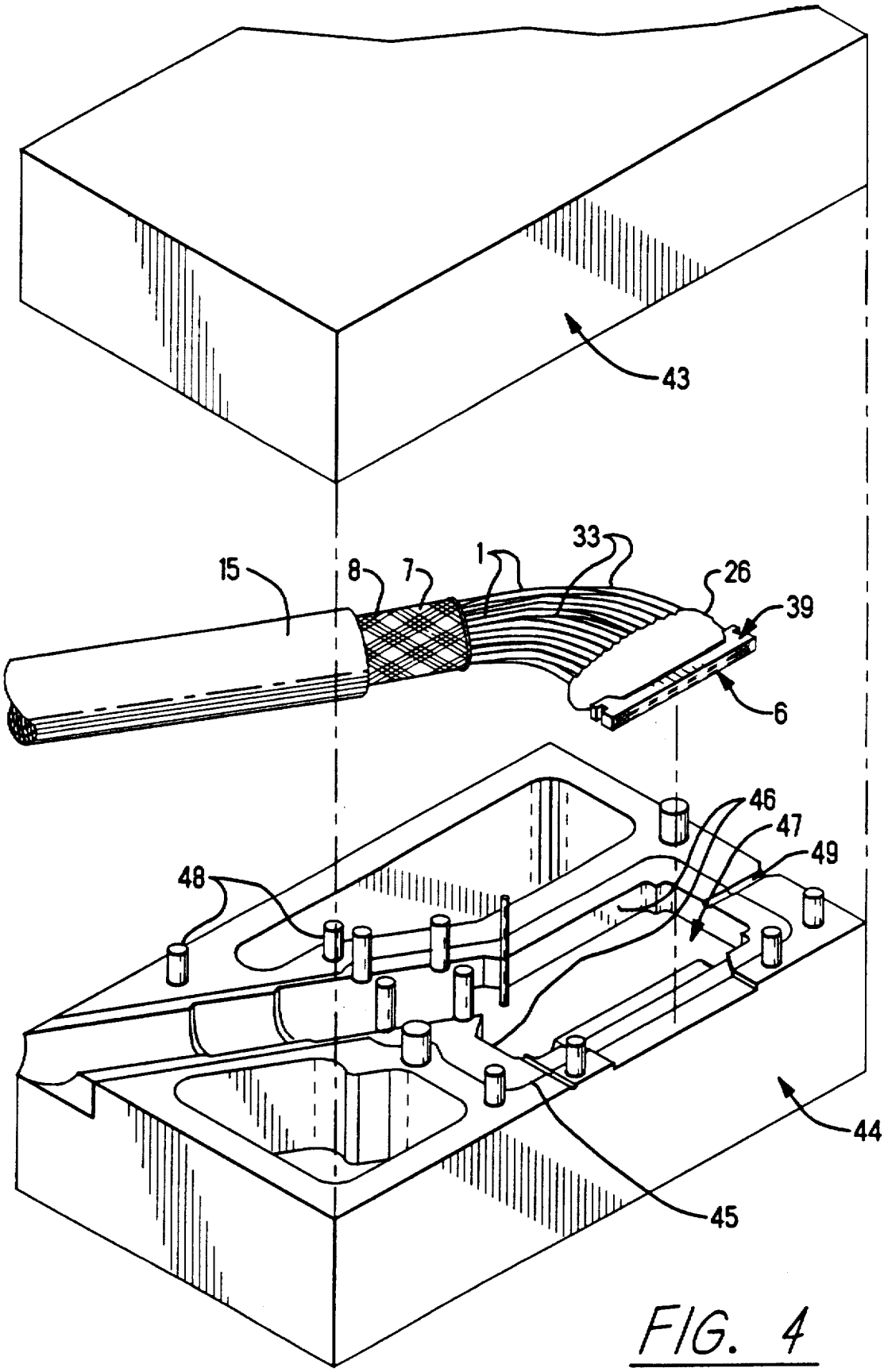
FIG. 4 is a perspective view of a portion of the connector shown in FIG. 1, together with mold dies of a molding apparatus.

The connector 6, FIGS. 1 and 4, further includes a metal sleeve 7 encircling collectively the cables 1 associated with the housing block 16. The cables 1 further extend within a conductive, woven strands of an electrical shield 8 and an outer jacket or sheath 15. The connector 6 further includes, a first plastics material 26 covering the wire connecting portions 21 and 23 and corresponding bare portions of the wires 2 and 5 to prevent movement or electrical shorting to the wires 2 and 5.

The connector 6 includes additional plastics material 28 at a rear of the housing block 16 imbedding the ground bus 10 and a portion of each cable 1, and a conductive, bipartite, back shell 29 enclosing the plastics material 28. In the shell 29, the plastics material 28 conforms to an interior 30 of the shell 29. The back shell 29 includes a shell portion 31 and a cover portion 32 secured together by fasteners, not shown. The cables 1, including the signal wires 2 and the ground wires 5 are bent in arcs 33 that are imbedded in the plastics material 28. A side 34 of the shell 29 receives the cables 1 and the wires 2 and 5 through an opening 35.

A groove 36 through the plastics material 28 provides a passage into which is nested a channel 37 recessed in the exterior of the shell 29 that receives a fastener, not shown, such as a jack screw used to fasten the connector 6. End walls 38, 38 of the channel 37 are provided with openings 41, 41 to receive the fastener. The shell 29 provides a cradle 42 to support the fastener.

Figure 5:
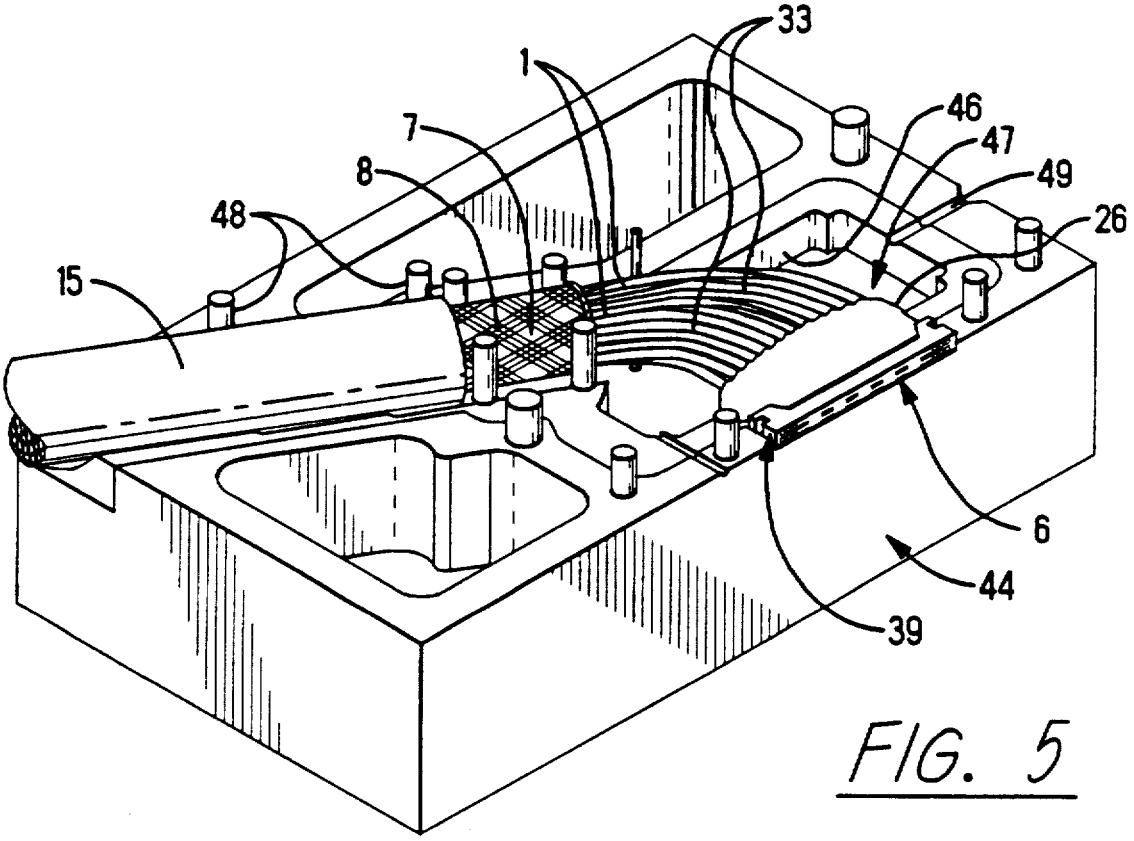
FIG. 5 is a perspective view of a a portion of the connector laid in one of the molding dies shown in FIG. 4.

With reference to FIGS. 1, 4 and 5, mold dies 43, 44 of a known molding apparatus are provided with corresponding mold inserts, one shown at 45, having corresponding insert cavities 46. The dies 43, 44 close toward and against each other, such that opposed insert cavities 46 close together and form a mold cavity 47 conforming in size and shape to the interior of the conductive back shell 29. The cables 1, including the wires 2 and 5, are bent in the arcs 33 where the wires 2 and 5 enter the housing block 16. They are then laid in a corresponding insert cavity 46, FIG. 5, of the die 44. The mold dies 43, 44 are closed together. Projecting alignment pins, some of which are numbered 48, in the die 44 will engage and align the other die 43.

The plastics material 28 in a fluent state is injected along a mold gate 49 into the mold cavity 47, imbedding the arcs 33 within the fluent plastics material 28. The mold cavity 47 will mold the plastics material 28 to a shape conforming to the interior of the back shell 29, and will form the groove 36. The mold inserts 45 encircle the shield 8 and the sleeve 7, closing off the flow of the plastics material 28.

The mold inserts 45 also encircle the housing 39 of the connector 6 closing off the flow of the plastics material 28 from the housing 39. The first plastics material 26, applied earlier in the process, blocks the flow of the plastics material 28 along the contacts 9 and into the housing 39. The plastics material 28 is formed with a tapered extention 50 to cover the plastics material 26 and adhere to the exterior of the housing 39.

Following solidification of the plastics material 28 in the mold dies 43, 44, the mold dies 43, 44 open apart and the connector 1 is removed. The fluent plastics material 28 will have formed into a solid, shaped block having exterior sides 51, 52, ends 53, 54, and a rear 55, all supported against the interior of the shell 29. The cables 1, including the wires 2 and 5, are embedded in the plastics material 28, and are supported by the plastics material 28 to resist movement.

Figure 6:
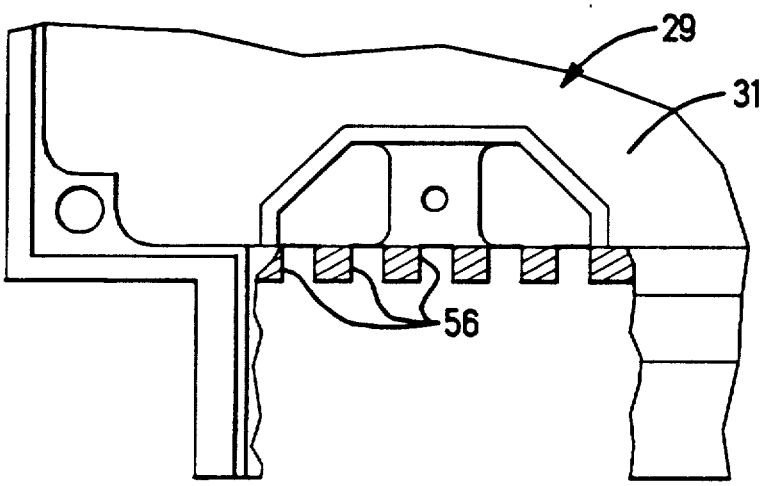
FIG. 6 is an enlarged fragmentary elevation view of a back shell, partially broken away, of the connector shown in FIG. 1.

With reference to FIG. 6, the shell portion 31 has a series of rectangular keyways 56 opening into the interior of the shell 29. The shaped block of the plastics material 28 is formed with a recess 57, FIG. 1, formed by a ridge 58 in the mold die 44, FIG. 4. When a key, not shown, is inserted into a selected one of the keyways 56, the key will register in the recess 57 that opens into a front 59 and the side 52 of the block of the plastics material 26.

We claim:

1. An electrical connector comprising: an insulative housing block, conductive electrical contacts in the housing block connected to corresponding signal wires of a cable, a conductive ground bus connected to corresponding ground wires, plastics material at a rear of the housing block imbedding the ground bus and a portion of the cable, and a conductive shell enclosing the plastics material, arcs of the signal wires and the ground wires being embedded in plastics material.

2. An electrical connector as recited in claim 1, and further comprising: a groove through the plastics material receiving a fastener.

3. An electrical connector as recited in claim 1, and further comprising: a recess opening into a front and a side of the plastics material for receiving a key of the shell.

4. An electrical connector as recited in claim 1, and further comprising: a side of the shell receiving the wires.

5. An electrical connector as recited in claim 1, and further comprising: the plastics material being a shaped block conforming in size and shape to the interior of the conductive shell.

6. An electrical connector as recited in claim 1, and further comprising: when the plastics material is assembled in the shell, the plastics material conforms to an interior size and shape of the shell.

7. An electrical connector as recited in claim 1, and further comprising: the plastics material having been formed into a block having a size and shape conforming to the interior of the shell.

8. A method for constructing a connector comprising the steps of:

bending signal wires and ground wires in arcs where the wires enter a housing block holding electrical contacts to which the wires are connected, imbedding the arcs within fluent plastics material, molding the plastics material to a shape conforming to an interior of a conductive shell, and assembling a conductive shell over the plastics material following solidification thereof.

9. A method as recited in claim 8, and further including the step of:

exiting the wires through a lateral side of the plastics material, and covering a back portion of the plastics material with the shell, and exiting the wires through an opening in a side of the shell.

10. A method as recited in claim 8, and further comprising the step of: laying the housing block and the wires in a cavity of a mold conforming in size and shape to an interior of the shell, and filling the cavity with the fluent plastics material to imbed the wires in a shaped fluent plastic solid.

* * * * *